United States Patent [19]

Criscimagna et al.

[11] Patent Number: 4,683,470

[45] Date of Patent: Jul. 28, 1987

[54] VIDEO MODE PLASMA PANEL DISPLAY

[75] Inventors: Tony N. Criscimagna, Woodstock; Harry S. Hoffman, Jr., Saugerties; William R. Knecht, Kingston, all of N.Y.

[73] Assignee: International Business Machines Corporation, Armonk, N.Y.

[21] Appl. No.: 708,328

[22] Filed: Mar. 5, 1985

[51] Int. Cl.[4] ..... G09G 3/28

[52] U.S. Cl. ..... 340/771; 340/776; 315/169.4

[58] Field of Search ..... 340/771, 776, 777; 315/169.4, 169.1

[56] References Cited

U.S. PATENT DOCUMENTS

| | | | |
|---|---|---|---|
| 4,104,563 | 8/1978 | Schlig et al. | 340/771 |
| 4,415,892 | 11/1983 | Marentic | 340/776 |
| 4,524,352 | 6/1985 | Greeson, Jr. | 340/771 |
| 4,570,159 | 2/1986 | Criscimagna et al. | 340/776 |

*Primary Examiner*—Gerald L. Brigance

*Attorney, Agent, or Firm*—Joseph J. Connerton

[57] ABSTRACT

An a.c. Plasma Display Panel is operated in a scanning mode using a conventional video data stream such as that applied to a cathode ray tube display terminal. A full line write followed by a selective erase technique is employed for image generation on a line by line basis. By eliminating the non-selective write signal used in normal plasma display operation, the duration of the sustain signal is substantially decreased and the write, erase and sustain functions are provided at a nominal 40KC rate.

5 Claims, 13 Drawing Figures

VIDEO MODE PLASMA PANEL DISPLAY

CROSS REFERENCE TO RELATED APPLICATIONS:

U.S. application Ser. No. 372,384 "Improved Method and Apparatus for Gas Display Panel", filed by Tony N. Criscimagna et al. June 21, 1973 now U.S. Pat. No. 4,591,847.

U.S. application Ser. No. 06/591,099 "Video Mode Plasma Display" filed by Tony N. Criscimagna et al. Mar. 19, 1984 now U.S. Pat. No. 4,611,203.

BACKGROUND OF THE INVENTION

In an a.c. all points addressable plasma display panel (ACPDP), parallel conductor arrays disposed on glass plates with the conductor arrays disposed in a substantially orthogonal relationship are overcoated with a dielectric and refractory layer, and the glass plates edge sealed to form a panel, the panel containing an ionizable gas, the intersections of the conductor arrays defining display cells. The plasma display operates in three modes; write, sustain and erase. Writing is accomplished by applying appropriate amplitude drive signals to the conductor arrays whereby the display cells are selectively discharged to provide a visible display. The plasma discharge also forms a wall charge potential on selected cells which constitutes a memory. The display is maintained by a lower amplitude sustain signal which combines with the wall charge potential to continuously discharge selected display cells at a nominal 40 kHz rate. Erasing is performed by effectively neutralizing the wall charge at the selected cells, such that the combined wall charge potential and the sustain signal is insufficient to discharge the cell. The above described operation is more fully described in the referenced U.S. Pat. No. 4,591,847.

The waveform for sustain, write and erase operations serve separate functions as described above, and each function heretofore occupied separate time periods. The selection system full-selects part of the pels (picture elements) in the panel, half-selects others and non-selects the remaining pels. The signal summation is sustain plus write voltages for a full select, sustain voltage only for a half-select and sustain voltage minus write voltage for a non-select. The non-select case requires an adequate sustain voltage duration before the beginning of the write pulse to provide the non-sustain function.

In the aforereferenced U.S. Pat. No. 4,611,203, hereinafter designated the 203 patent, a 720×350 pel section of a 960×768 pel a.c. plasma panel operating from an IBM Personal Computer's CRT video adapter card was described. The video data rate was approximately 16 mHz, and the refresh rate was a non-interlaced 50 frames per second. Plasma panel technology is designed to operate at a nominal (±10%) video cycle rate of 40 kHz to provide normal display intensity. In U.S. Pat. No. 4,611,203 patent, the system video updating was provided on a line by line basis by a full line write followed by a selective erase of the video data. To provide a nominal 40 mHz data rate needed for the 40 kHz cycle rate, it is apparent that the 16 mHz video data rate must be modified to approximate the update rate needed for plasma display operation.

SUMMARY OF THE INVENTION

The subject invention is directed to a system for updating a plasma panel at a rate compatible with plasma display operation. An a.c. plasma display system is designed to operate in video mode using a full line write followed by a selective erase technique. Conventionally, during a write operation, as described in the aforereferenced U.S. Pat. No. 4,591,847, the write system requires a full length sustain signal to which a write pulse is selectively added. Further, the period of the sustain signal is increased during a write operation, frequently by a factor of two, since a full width sustain signal is required before the write pulse begins. In the preferred embodiment of the invention using a full line write, both the write and sustain functions are such that there are only fully selected pels on the selected line and half selected pels in all other positions. There are no non-selected pels, so the requirement for longer duration sustain signals for the non-selected case is eliminated. The sustain and write signals are, in fact, coincident. The resultant time saving permits faster operation of the system to correspond to the data register loading speed and to the speed required for normal intensity. The instant invention provides reliable write, sustain and erase operations, while reducing the combined time to accomplish the functions of sustain, write and erase.

DESCRIPTION OF A PREFERRED EMBODIMENT

Figure 1:
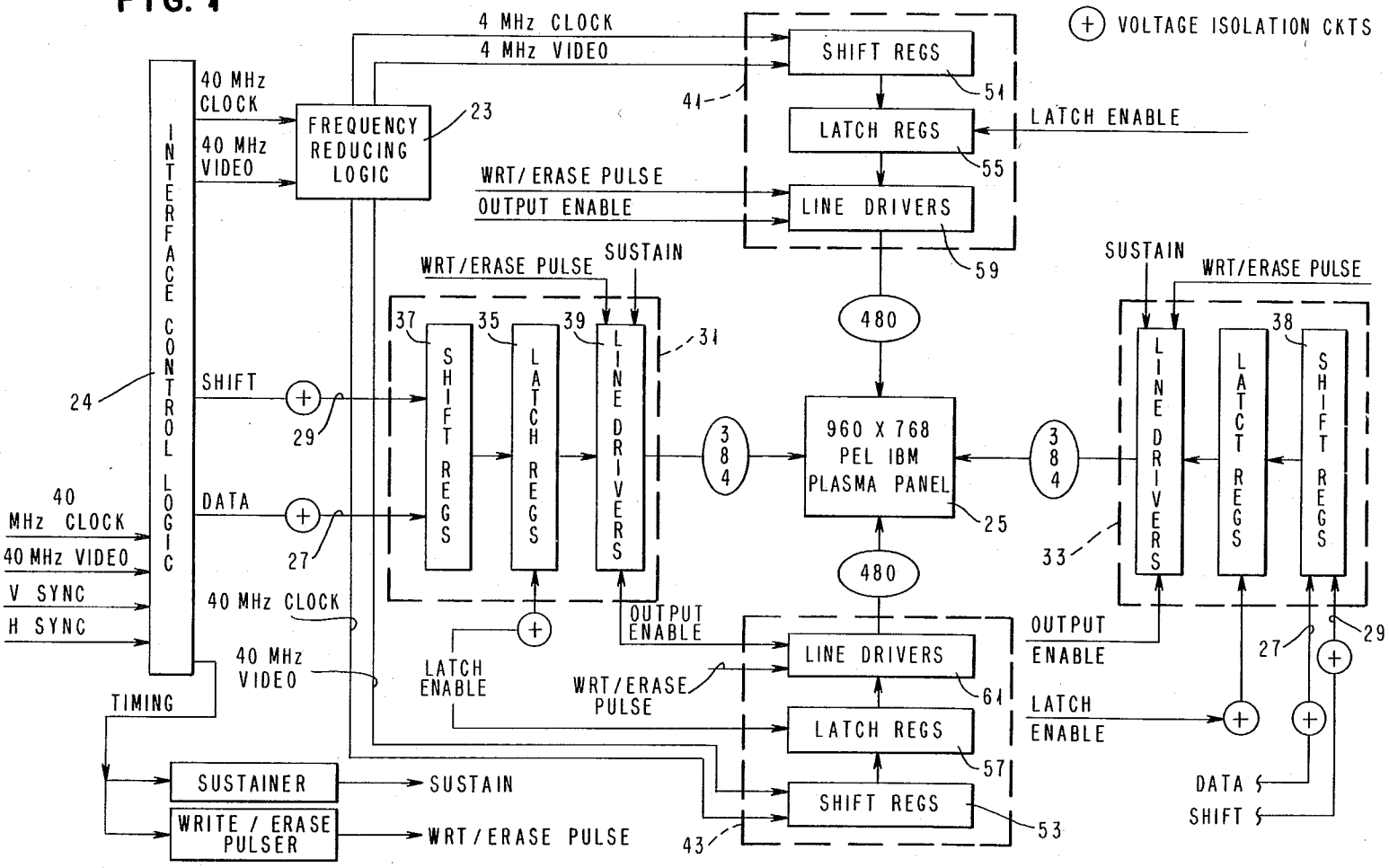
FIG. 1 illustrates in block schematic form the data path and control logic for generating a display on a plasma display monitor.

Referring now to the drawings and more particularly to FIG. 1 thereof, the operation of the instant invention will be described from the interface and control logic block 21, which has four inputs, a 40 MHz clock, a 40 MHz video source and vertical and horizontal synchronization signals. In the preferred embodiment of the invention, the 40 MHz video data is applied only to the vertical lines, while the horizontal registers function for line selection under control of a logic block 21. The 40 MHz video data stream is applied to a frequency reducing logic block 23, where it is reduced to ten 4 MHz data streams. Although not shown at this level of detail and unnecessary to an understanding of the subject invention, this logic splits the 40 MHz video streams into 10 parallel, 4 MHz video streams having pulse widths to match their lower frequencies. Five of these data streams are applied to each of the driver modules 41, 43 which generate alternate drive signals from opposite sides of the panel. The cell configuration for plasma display panel 25 is 960 vertical lines×768 horizontal lines for a total pel content of approximately three quarter million. While operated in video rather than xy selection mode, panel 25 is a commercially available a.c. plasma panel, commercially available as the IBM 3295 Plasma Monitor.

The interface control logic 24 applies address data through data line 27 and shift line 29 to horizontal driver modules 31 and 33, each of which handles half of the horizontal lines, or 384 lines in alternate sequences. Since the driver modules 31 and 33 are identical, only one will be described in detail. Driver module 31 has a buffer latch register 35 between the input shift register 37 and the output line drivers 39. Interface and control logic 24 uses the vertical Interface and vertical synchronization signal to condition control logic for the beginning of a frame by priming each of horizontal shift registers 37, 38 with a single shift bit to select the upper two panel lines, and then by using the output enable line 45, selects the first horizontal line to start the frame. The horizontal synchronization pulse applied to interface and control logic 24 signals the impending arrival of video data and assists frequency reducing logic 23 to handle the video data as it arrives.

The vertical driver modules 41 and 43, identical, are not conventional plasma panel driver modules. Conventional plasma panel driver modules cannot be used for the vertical line function because the panel line updating is overlapped with the loading of video data for the next panel line. The video data stream and associated clock pulses, as heretofore described, are applied from frequency reducing logic 23 to the shift registers of vertical driver modules 41 and 43.

Once the video data is loaded into the vertical shift registers 51, 53 of driver modules 41 and 43, it is buffered in latch registers 55, 57 and the panel line is updated through drivers 59, 61, while the video data for the next panel line is being loaded into the shift registers 51, 53 respectively. Each of the driver modules 41, 43 handle 480 alternate vertical lines. After each panel line is updated, the single floating shift bit in horizontal shift registers 37, 38 is advanced one position to select the next panel line, and the process repeats itself until the entire panel has been updated.

As described above, 2 horizontal lines of 960 pels each are completely selected. The lower of the lines provides piloting action for the adjacent upper line, which is selectively erased to generate a line of video data. Every panel line, from top to bottom, is updated using a complement convention. During vertical synchronization time, all the cells of panel line 1 are turned on. This initial step prepares the way for the line updating sequence that follows. During each sweep time, the line ahead of the current line has all its cells turned ON, and then the current line is selectively erased in accordance with the shift register data to produce the desired line image patterns. In this way, the cells erased always have an adjacent cell in the ON state, and a good erase is therefore guaranteed, eliminating Pattern and Sequence Sensitivity, a plasma display problem described in the 203 Patent.

In order to refresh the panel at approximately 50 frames per second, 768 panel lines have to be updated in about 20 milliseconds, which allows 27 microsecoonds for the updating of each panel line. As herein employed, the term "updating" designates one erase and one write operation. For plasma panel operation, the sustain function must also be provided during these continual write and erase operations. The problem solved by the instant invention is how to reliably write and erase in a sustain cycle that is substantially shorter than the conventional plasma write and erase cycle, i.e., about 27 microseconds.

Figure 2:
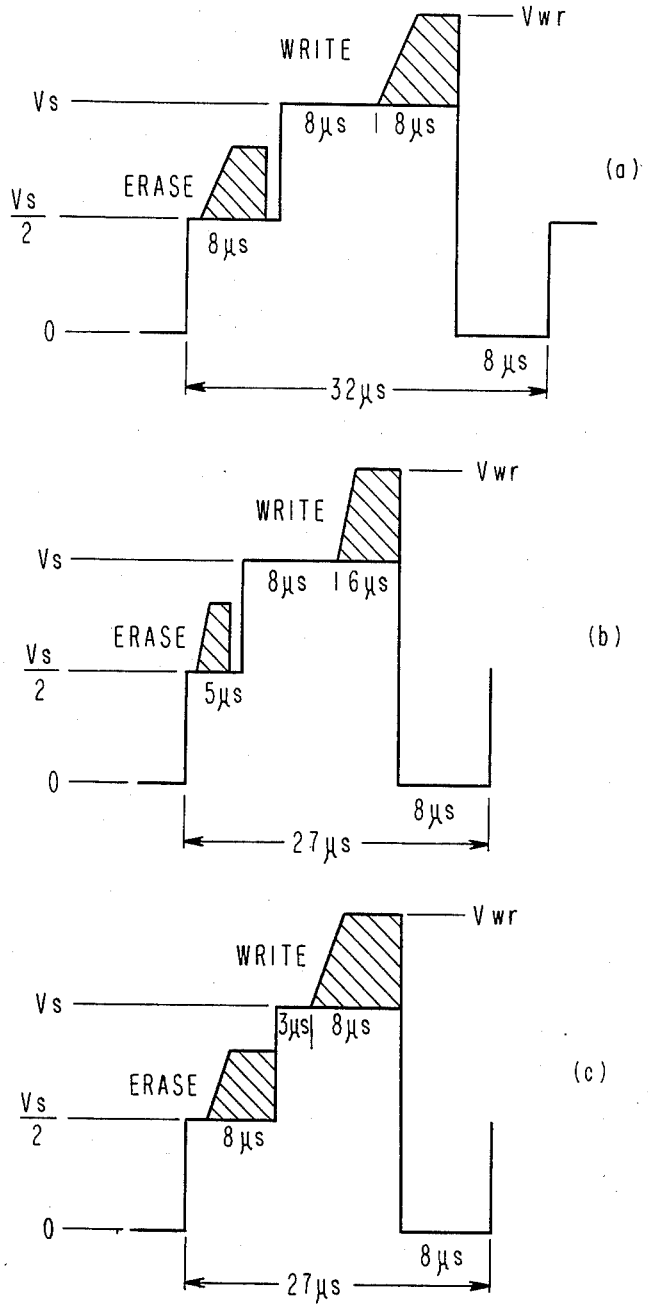
FIG. 2 illustrates alternate groups of waveforms used to provide the sustain, write and erase functions of plasma display operated in video mode.
Figure 3:
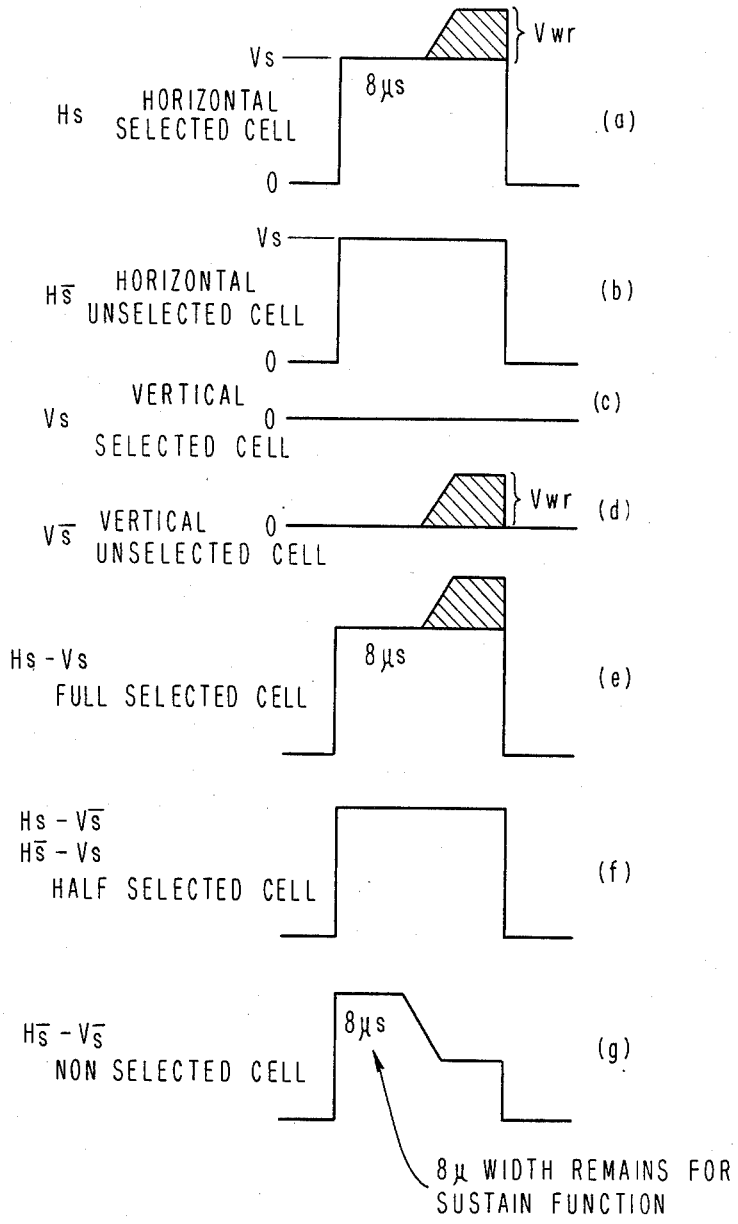
FIG. 3 illustrates the waveforms generated across selected and unselected cells of the plasma display operated in video mode.

Referring now to FIGS. 2 and 3, the operation of the instant invention will be described in terms of the waveforms utilized in providing the sustain, write and erase functions. As described in the referenced 203 Patent, slope waveforms, in which the write or erase pulse has a slope on its leading edge, are preferred over conventional rectangular pulses, since they produce less crosstalk or noise in operation. Also, in the preferred embodiment of the invention, as previously described, video data is updated by writing all ones followed by selective erase.

Referring now to FIG. 2(*a*), reliable write and erase operations employ slope waveforms about 8 microseconds in duration. Each sustain iteration between 0 and $V_s$ requires 8 microseconds to gather charge. Thus, a combined cycle where write, erase and sustain, each requiring 8 microseconds, are integrated, as shown in FIG. 2(*a*), would require a total of 32 microseconds, resulting in a sustain frequency of approximately 30 kHz. This frequency is far below the nominal frequency of 40 kHz and reduces panel brightness significantly.

FIG. 2(*b*) illustrates the results of reducing the write and erase pulses to their absolute minimums, where the combined cycle is reduced to 27 microseconds. While the result is within the nominal 40 kHz cycle rate, the erase pulse is reduced to 5 microseconds and the write pulse to 6 microseconds for a total time saving of 5 microseconds. However, higher amplitude write and erase signals are required, while the write and erase margins are reduced. Further, these write and erase pulses are on the edge of satisfactory operation, and pulse durations below these values cannot be tolerated, producing a critical tolerance problem.

If conventional full pulse widths are required, the only remaining way to reduce the combined cycle to 27 microseconds would be to reduce the two 8 microsecond sustain alternation widths. While the sustain alternations could be reduced to 7 microseconds, this would only provide a two microsecond saving, while producing a marginal operation. The ultimate solution will be described relative to FIG. 2(*c*) after reference to the FIG. 3 description.

FIGS. 3(*a*)–3(*d*) illustrate the waveforms for the horizontal and vertical sustain at write time, and the write pulse for both selection states (selected and unselected) on the same axes. In the preferred embodiment of the instant invention, a full amplitude sustain signal from 0 to $V_s$ is applied to the horizontal axis (FIG. 3(*b*)), while the selected vertical axis is maintained at a reference level, normally ground (FIG. 3(*c*)). A slope write pulse is applied to the horizontal sustain (FIG. 3(*a*)), while the unselected vertical cells have a similar signal applied thereto (FIG. 3(*d*)). FIGS. 3(*e*)–3(*g*) show the composite waveforms for the three selection states, full-select, half-select and non-select for a cell being written. FIG. 3(*e*) shows the full-select state, while FIG. 3(*f*) shows the half-select state. In the half-select state of FIG. 3(*f*), sustain appears much wider than necessary.

In the non-select state in FIG. 3(*g*), the rear or trailing edge portion of the extra wide sustain is cancelled by the vertical unselected cell waveform, leaving only an 8 microsecond interval at the $V_s$ level. Thus, the apparently excessively long alternation time at write time is very necessary and cannot be altered in a plasma panel where all three selection states (full, half, non) must be anticipated and provided for.

This restriction does not apply in the video mode as implemented. Because of the method used to update each panel line, all three selection states do not exist at write time because the entire panel line (all cells) is written or selected. Thus, there are only fully selected pels on the selected lines, and half-selected pels in all other positions; there are no non-selected pels. At write time, every vertical line is selected, guaranteeing that at least a half-select condition occurs on every panel cell. In the video mode, at write time, only two selection states exist - the full-select state and the half-select state. The full-select state appears on the panel line being written. The half-select state appears on all the remaining cells of the panel, providing them with a full 8 microseconds sustain.

Returning now to FIG. 2(*c*), which illustrates a composite write, sustain and erase waveform utilized in the present invention, the 8 microseconds sustain alternation before the non-selected write pulse, as previously described, is no longer required. This allows the combined cycle to be realized using the optimum sustain, write and erase widths of 8 microseconds each to form a composite signal of 27 us, with 3 us to spare, and a corresponding sustain frequency of 37 kHz. If only the minimum required 24 microseconds were utilized, the invention could operate at a data rate above 40 MHz.

While the preferred embodiment of the invention has been described in terms of a full write followed by selective erase sequence, the invention could also operate with a full write followed by full erase followed, in turn, by a selective write sequence. It is also possible, where time saving is not critical, to combine a sustain, a selective write and a selective erase signal in a combination waveform. This can provide some time saving over the conventional selective write and selective erase without the limitation of a full line write.

While the invention has been shown and described with reference to a preferred embodiment thereof, it will be understood that various substitutions in form and detail may be made by those skilled in the art without departing from the spirit and scope of the invention.

What is claimed is:

1. In a plasma display device operated in video mode;

a plasma display video monitor having a plurality of display cells arranged in a matrix configuration; and means for generating a visual representation of a data stream of video signals during a sequence of horizontal scan line operations, said means including, addressing means for updating said panel on a scan line basis, said addressing means generating a write sequence applied to a first scan line whereby all display cells in said scan line are written, said write sequence comprising a full write signal applied in coincidence with a sustain signal during the normal sustain alternation, said addressing means generating a selective erase sequence to selectively erase the cells in said first scan line in accordance with the contents of said data stream, said selective erase sequence comprising an erase signal positioned near the leading edge of a sustain signal alteration, and a second full select scan line for priming said first scan line during said selective erase sequences, the duration of said write and erase sequences defining the update time of said plasma display device, said full line write sequence applied to all cells in said first and second scan lines combined with said selective erase sequence in said first scan line eliminating the conventional plasma display non-select state of said plasma display device and the time associated therewith whereby the combined time for sustain, write, and selective erase sequences is substantially reduced to correspond to the data rate of said data stream of video signals.

2. A device of the character claimed in claim 1 wherein said second full select scan line is positioned in proximity to said first scan line to facilitate said selective erase operation.

3. A device of the character claimed in claim 2 wherein said second full select scan line is positioned immediately below said first scan line.

4. A device of the character claimed in claim 2 including means for synchronizing the vertical movement of said first and second scan lines with a line scanning operation whereby said lines are maintained in proximate relationship as said first scan line is being selectively erased.

5. A device of the character claimed in claim 1 wherein said write and erase operations require only a single sustain cycle.

* * * * *